United States Patent [19]

Pinto et al.

[11] Patent Number: 4,908,910

[45] Date of Patent: Mar. 20, 1990

[54] PROCESS AND APPARATUS FOR BLENDING FIBERS OF AT LEAST TWO FLOWS OF FIBER MATERIAL, IN PARTICULAR SPINNING MATERIAL

[75] Inventors: Akiva Pinto, Duesseldorf-Wittlaer; Guenter Lucassen, Haltern; Reinhard Schmidt, Gescher, all of Fed. Rep. of Germany

[73] Assignee: Hergeth Hollingsworth GmbH, Deulman, Fed. Rep. of Germany

[21] Appl. No.: 240,988

[22] Filed: Sep. 6, 1988

[30] Foreign Application Priority Data

Sep. 18, 1987 [DE] Fed. Rep. of Germany ..... 3731377

[51] Int. Cl.[4] ..... D01G 7/04; D01G 7/06

[52] U.S. Cl. ..... 19/145.5; 19/81

[58] Field of Search ..... 19/65 A, 80 R, 97.5, 19/102, 105, 145.5, 145.7, 297, 300, 81; 209/599

[56] References Cited

U.S. PATENT DOCUMENTS

| | | | |
|---|---|---|---|
| 2,851,737 | 9/1958 | Hunter et al. | 19/145.5 |
| 3,071,202 | 1/1963 | Lytton et al. | 19/145.5 X |
| 4,133,455 | 1/1979 | Moser | 19/105 X |
| 4,187,584 | 2/1980 | Trutzschler | 19/145.5 X |
| 4,244,082 | 1/1981 | Leifeld et al. | 19/145.5 X |

*Primary Examiner*—Donald Watkins
*Attorney, Agent, or Firm*—Cort Flint

[57] ABSTRACT

A process and apparatus for blending fibers of a plurality of fiber flow is disclosed which includes a fiber feed device (2a, 2b, 3a, 3b) which feeds fiber layers (12) through an angular channel (13, 14) which rearranges the vertical layers into generally upright sections (12a) for transportation and weighing on a conveyor (14) by means of a weighing device (4a, 4b). The weighed fibers are delivered by intake rolls (32, 33) to a common opening roller (20) which opens and mixes the fibers according to a predetermined ratio as controlled by the weighing device. Fibers are discharged by a pneumatic source (40) to individual storage units (41), each of which may be made to store a different blend ratio.

19 Claims, 3 Drawing Sheets

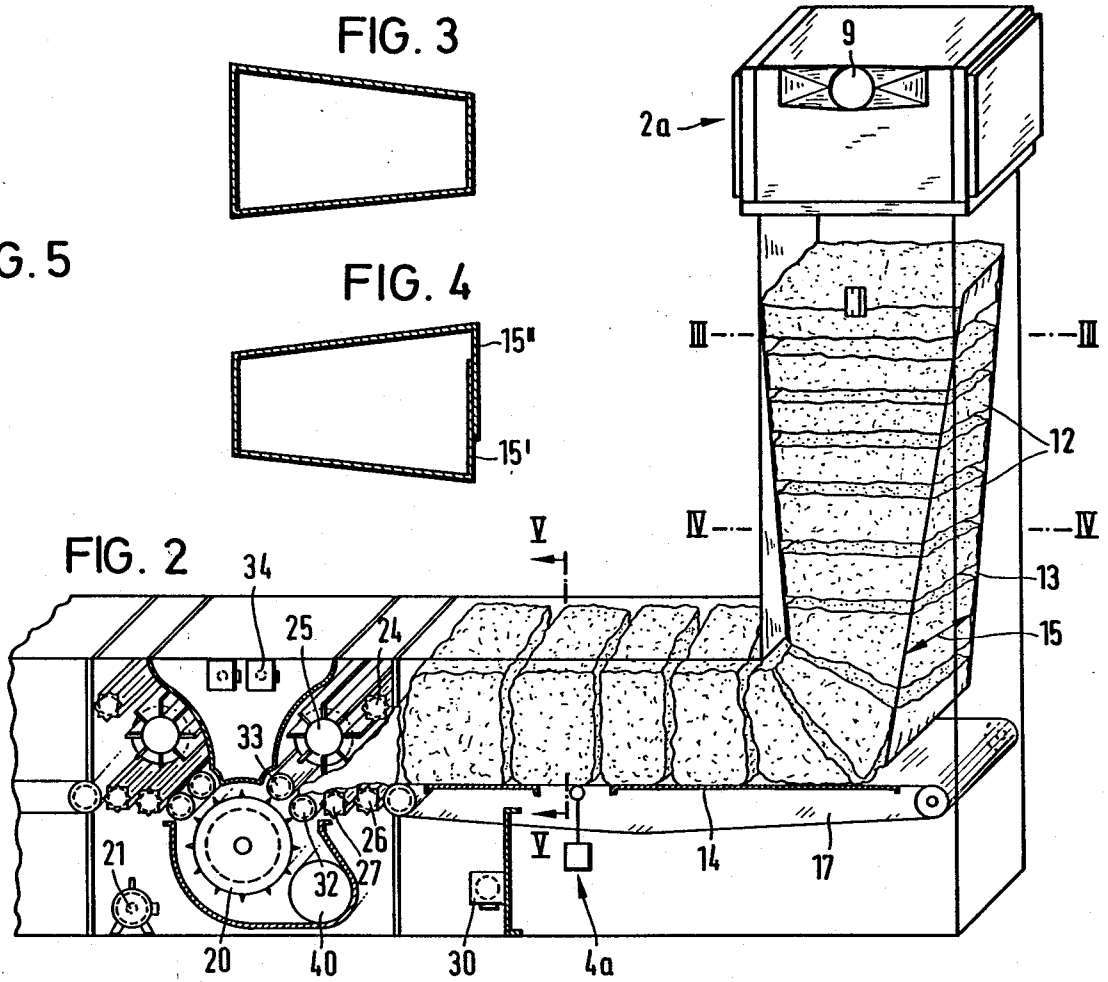
FIG. 2
FIG. 3
FIG. 4
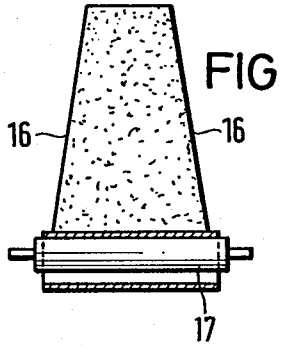
FIG. 5

PROCESS AND APPARATUS FOR BLENDING FIBERS OF AT LEAST TWO FLOWS OF FIBER MATERIAL, IN PARTICULAR SPINNING MATERIAL

BACKGROUND OF THE INVENTION

The invention relates to a process and apparatus for blending at least two flows of fiber material, in particular spinning material, e.g. cotton, synthetic fibers, wherein the fiber flows are weighed individually over a predetermined distance, and subsequently united to a common fiber flow.

It has been known that the quality of the product of a processing machine in the spinning mill preparation is dictated by the condition of the fibrous web to be presented to the processing machine. In particular, quality is affected by the homogeneity of the fibrous web delivered to a processing machine, e.g. a card or the like. This is also true if two or more fibrous webs have to be blended with each other. It is important, in this connection, that the blending ratios are kept constant during the feeding of the processing machine. Very often, the moving fibrous web is weighed continuously during feeding in order to constantly control, by the weight, the equal amount of fiber material to be delivered. The blending of two fiber flows is realized by superposing them. The total layer is fed to an automatic blending machine or directly to a carding machine. This is not very practical and a reliable and perfect blending may not be achieved at all (U.S. Pat. No. 4,133,455).

It is an object of the present invention to substantially improve and better control by simple means the blending of two or more fiber flows of a different type and quality. Another object of the present invention is to obtain a uniform measuring of the fiber amount of the flow provided for blending.

SUMMARY OF THE INVENTION

The invention is characterized, in connection with the preparation of blended fibers, in that weighed and measured quantities of fiber flow are commonly opened in being mixed together and the resultant mixture of opened fibers is supplied to a processing machine or the like.

The above objectives are accomplished according to the present invention by delivering the weighed fiber flows directly to an opening means, such as an opening roller. The fiber flows are directly and intensely blended during their opening. An automatic blender or an independent mixing assembly need not be used. Blending is not left either to a card or to another processing unit, but it is carried out directly during the opening of the fiber flows. The degree of blending ensured in the opening zone is extremely high. Output and quality of blending are substantially improved over the methods used hereto. The blending operation may be simply and quickly realized and is controllable at any time. With respect to the fiber flows to be fed to the opening stage, the blending ratio may be changed quickly and without any inconvenience. In spite of the continuous performance, the blending operation may be adjusted to another blending ratio. Moreover, as compared to the known method, the constructional expenditure is extremely low.

Due to the possible simple and quick variation of the fiber flow feed ratios during blending, the invention offers a high flexibility as to use and availability of different blending ratios of the fiber material to be delivered. A quick adjustment is possible without the need of working away considerable residual batches. Subject to the adjusted blending ratio, the opened and blended fiber flow is stored separately. The supply to a processing point is subsequently performed from a predetermined storage point. Hence, a continuous operation of the equipment is ensured by simple means.

Another feature of the invention is based on the finding that the uniform weight of a continuously supplied fibrous web is dependent on the manner in which the fiber material is supplied to and discharged from the weighing means and in which it is delivered to the opening means. In case of fiber layers to be mixed, this uniform weight is important in order to avoid troubles concerning the quality of the desired product. To this effect, for the weighing operating, the fiber material is supplied sectionwise, but in a close succession. Preferably, in the weighing line, the guiding position of the fiber material sections is upright.

By the sectionwise division of the fiber material, which has no gaps as it passes the weighing line, each section is safely and correctly weighed per se, thus contributing to a more reliable weighing operation. Although the fiber layer to be delivered is uninterrupted spatially, there is a certain separation between the sections, in other words, there is no coherence by interengaged or mutually entangled sections. This is most favorable for the weighing operation because section by section may be weighed exactly and safely with a resultant considerable improvement of measuring accuracy. This is particularly true if the sections are arranged in a mutually vertical relationship. For its delivery to the weighing means, the fiber material is piled vertically or obliquely to form substantially horizontal layers which are directed into sections which stand upright and are fed to the weighing line. By this means, upright fiber material sections are continuously fed by simple means to the conveyor-type weigher. No intake rollers are required.

According to another feature of the invention, the means for feeding fiber material to the weighing means comprises an angularly extending channel composed of a vertical or oblique channel portion followed by a horizontal channel portion containing a conveyor belt-type weighing means. A device for depositing layerwise fiber material is arranged at the beginning of the upright channel portion. The fiber web may be fed continuously to the weighing means, in closely adjacent, subdivided sections which are in contact, although their respective fibers remain separated. As an adequate device for the layerwise deposition of fiber material, use is made of a cell wheel whose cell chambers are subdivided by a transverse screen surface. A discharge by layers and sections of the supplied fiber material may be safely performed accordingly.

Accordingly to another feature of the invention, the weighed fiber material is fed to an opening roller. Between the weighing line and the opening roller is a conveyor roller system. The conveyor roller system may consist of a row, or upper and lower feed rollers, which, towards the opening roller form a tapered receptacle for receiving the fiber flow. It is advisable that one upper feed roller has a diameter being substantially larger than that of the other feed rollers. The intake rollers for supplying the weighed fiber layer to the opening roller follow subsequently. The intake rollers are preferably provided with a separate drive. A differentiated control is possible for the supply of the fiber material to the opening roller by the intake rollers, subject to a number of parameters, e.g. degree of humidity of cotton, measured weight and belt speed of the weigher. This is particularly true if a mixture of a number of fiber layers is provided for the common opening roller. A second feed of fiber material may be set up in a mirror-inverted position with respect to the opening roller. To determine the moisture of cotton, etc., a sensor may be mounted whose values may be additionally appreciated by the electronic control of the computer assembly. Preferably, a pneumatic suction unit is connected to the opening roller for removing the weighed and blended fibers. Blending may be further increased by setting up an additional supply or feed means in an axial direction of the opening roller on one or both sides thereof.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 2 is a schematic perspective view of the blending means of FIG. 1;

FIG. 3 is a cross-section according to lines 3—3 of FIG. 2;

FIG. 4 is a cross-section according to lines 4—4 of FIG. 2;

FIG. 5 is a cross-section according to lines 5—5 of FIG. 2; and

DESCRIPTION OF A PREFERRED EMBODIMENT

Figure 1:
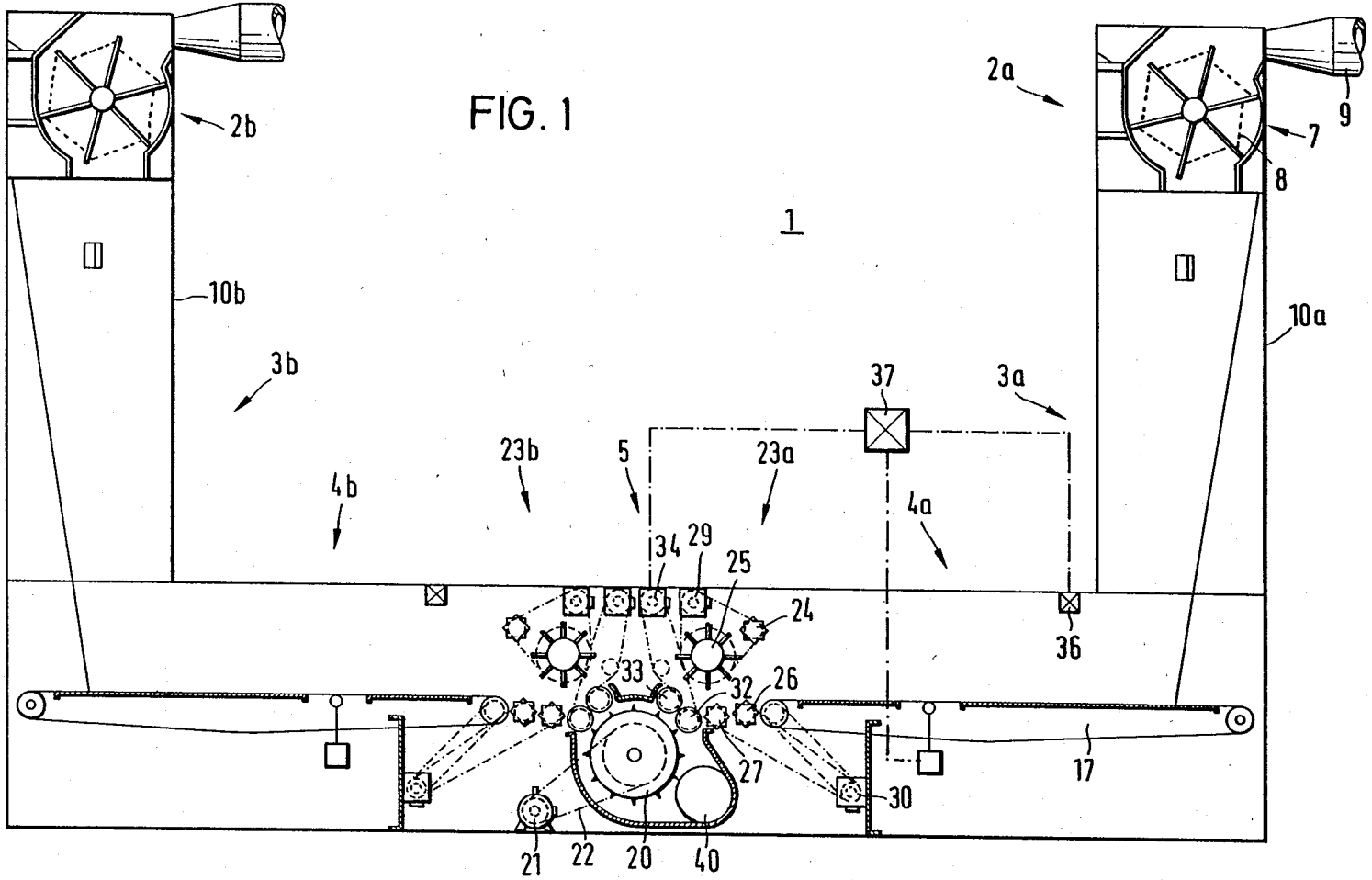
FIG. 1 is an elevational schematic view of a blending means of the invention.
Figure 6:
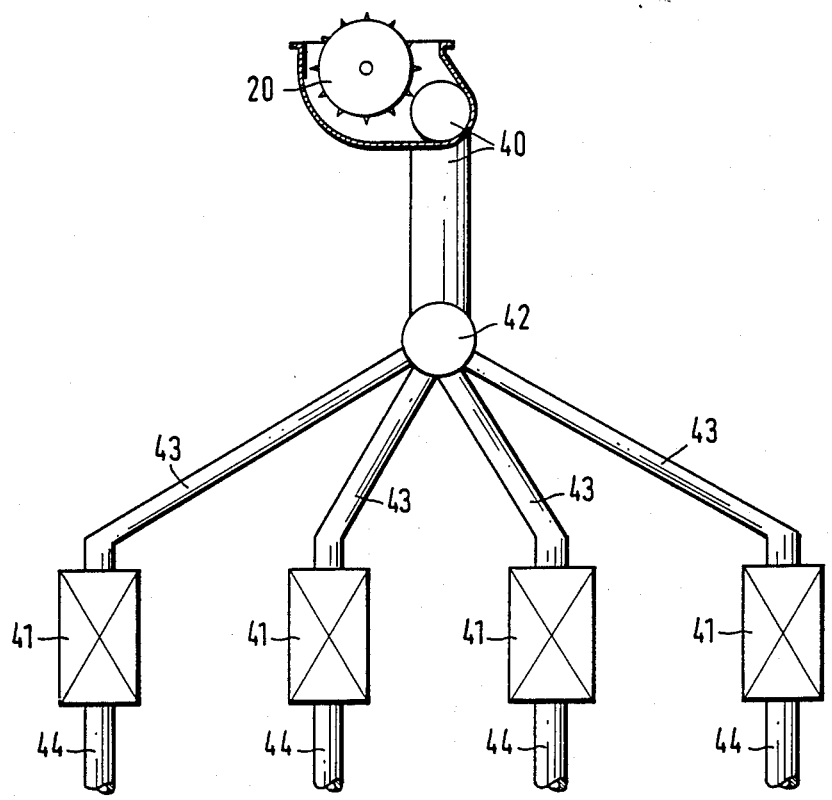
FIG. 6 is a schematic view of a preferred embodiment concerning the additional supply of the blended fiber to processing points.

Referring now in more detail to the drawings, a device 1 is illustrated for producing a blend of at least two flows of fiber material, e.g. cotton, etc. Device 1 comprises a feeder 2*a*, 2*b*, a delivery means 3*a*, 3*b* for delivering fibers to a weighing means 4*a*, 4*b*. An opening means 5 receives fibers from the weighing means which discharges the material to one or a number of processing points. The arrangement is provided in such a way that the weighed fiber flows supplied are fed to the common opening means 5 so that the blending of the fibers from two or more fiber flows may be realized directly during the opening operation. As a result, an excellent blending effect of fibers originating from at least two fiber flows may be achieved. Each individual fiber flow is controlled independently from the other flows to the common opening means. For this purpose, separate driving means are provided for each fiber flow which may be regulated and controlled individually. The individual assemblies of the total apparatus are designed as disclosed below.

As for the feeding and weighing means 2*a*, 3*a*, 4*a*; 2*b*, 3*b*, 4*b*, the fiber material is guided layerwise and sectionwise in close succession in the weighing line, as can best be seen in FIG. 2. In view of the layerwise deposition of the material, the feeding means 2*a*, 2*b* includes as a circulating member a cell wheel 7 whose cell chambers are covered by a transverse screening face 8. Thus, fiber material fed through the inlet 9 is thrown layerwise into the subsequent chute 10, 10*b*.

The assembly for feeding fiber material layers 12 to the weighing line 4*a* as upstanding sections comprises an angular channel including an upright or oblique channel portion 13 and an adjoining horizontal channel portion 14. Channel portion 14 receives the fiber flow weighing means 4*a*. As can best be seen in FIG. 2 and from the cross sectional views of FIGS. 3 and 4, upright channel portion 13 includes a downwardly tapered wall 13*a*, seen in the vertical plane of the horizontal channel portion, and a downwardly flared wall 13*b*, seen in the transverse plane. Further, the transverse wall 13*b* which is enlarged downwardly, is adjustable in width, for instance by overlapping wall parts 15′ and 15″. As results from the cross section of the horizontal channel portion 14, the side walls 16 are somewhat tapered towards the top (FIG. 5). By channels 13, 14 designed this way with respect to the weighing means for the fiber material flow conveyed sectionwise on the conveyor belt 17, the supplied fibers may be perfectly fed and conveyed to the weighing line 4*a* without using tractive force. No feed rollers are required. The material column 12 simply drops by its own gravity and is automatically redirected by the horizontal channel into the vertical arrangement of the sections 12*a*. Hence, the fiber material is presented free of tension on the weighing line 4*a*. A wrong tension or pressure of the material column fed to the weighing line may not occur. Further, due to the design of channels portions 13 and 14, any bridge formation of the material within the channel portions is safely excluded. The fiber material sections 12*a* are weighed in a vertical position. The contact surfaces of the sections being without any practical coherence, the weighing of the material passing the weighing line by means of conveyor belt 17 is realized perfectly and reliably. From the weighing line 4*a*, 4*b*, the material gets to the common opening means 20 which may include an opening roller also of the blending type. The drive of the opening roller 20 is ensured by motor 21 with the aid of transmission member 22.

The fiber material arriving from the weighing line is conveyed by a conveying roller system 23*a*, 23*b*. Systems 23*a* and 23*b* are of equal design so that only one of said systems will be described. The conveying roller system 23 consists of upper and lower feed rollers 24, 25, and 26, 27 which, towards the opening means 20, form a receptacle tapered like a wedge. A feed roller, suitably roller 25, has a diameter substantially larger than that of the other feed rollers 24, 16, 27. Feed rollers 24, 25 are driven by motor 29, while the lower feed rollers 26, 27 are driven by motor 30 also used to drive the conveyor belt 17.

The conveying roller system 23 is followed by a pair of intake rollers 32, 33 provided with a separate drive 34. Since each material column fed to the common disintegrating means 20 is provided with a separate driving means for the pair of intake rollers 32, 33, each fiber flow fed to the common opening means may be regulated and controlled independently of the others. The intake means 32, 33 is controlled by a computer device 37 in response to the weighing results. Fiber flows of different amounts may be fed to the common opening means, and the fibers of the various fiber flows may be of different materials, e.g. of cotton, synthetic material, etc. The fibers may also vary in length. In view of material absorbing humidity, e.g. cotton, a sensor 36 may be provided for determining the humidity. The humidity values determined by the sensor may be supplied to computer device 37 to control the intake rollers 32, 33 for maintaining the weights of the fiber material conveyed from the weighing means constant. Hence, care is taken that predetermined weights of the fiber material amounts are maintained for mixing the flows together in the common opening means. This contributes to an exactly controlled, and highly intensive blending of two or more fiber flows.

From the common opening means 20, the blended fiber material may be discharged by a pneumatically operated pipe conduit 40 to one or several processing points. Prior to directing the blended fiber material to a processing point, it is advisable to interconnect a predetermined number of storage means 41. The number of storage means is dictated by the predetermined number of the most important blending ratios of two or more fiber flows in the processing operation. Due to the disclosed blending device, a quick change from one blending ratio to another is possible without the need of processing residual amounts of the previously adjusted mixture. From the discharge conduit 40, the blended fiber material may be fed via a suitable pipe switch point 42 and through various conduits 43 to the storage means 41. It is possible for the separate discharge lines 44 to be joined to the desired further processing point. Due to the possible quick and simple adjustment of the blending means, changing marketing conditions of the fiber material may be immediately taken into consideration. Therefore, the total installation may be continuously operated to full capacity by simple means.

Preferably, a conveyor-type weighing means should be a mechanically separate assembly being kept free from the vibrations of adjacent elements so that no outward influences may affect the weighing procedure. The weighing means is mounted so as to be insensible for vibrations.

While a preferred embodiment of the invention has been described using specific terms, such description is for illustrative purposes only, and it is to be understood that changes and variations may be made without departing from the spirit or scope of the following claims.

What is claimed is:

1. A process for producing a blend of at least two flows of fiber material which includes weighing the fiber flows over a predetermined distance, and, subsequently mixing said weighed fibers to form a common fiber flow, wherein the improvement comprises blending said fibers by opening said weighed fiber flows together in a common fiber opening device to blend said fibers in a desired blend ratio, and discharging said blended opened fibers for further processing.

2. The process as set forth in claim 1 including adjusting said blend ratio of the opened blended fibers, storing fibers of different blend ratios separately, and delivering blended fibers to a processing point from a predetermined storage of fibers of a desired blend ratio.

3. The process as set forth in claim 1 including weighing said fibers in sections arranged in close succession.

4. The process as set forth in claim 3 including changing said fiber sections from generally vertical layers to upright sections when moved in a horizontal weighing line.

5. The process as set forth in claim 1 including feeding said fibers as stacked substantially vertical layers and thereafter redirecting said layers as generally upright sections for upright weighing.

6. Apparatus for producing a blend of at least two flows of fiber material of the type which includes feeding and weighing means for weighing said fiber flows over a predetermined distance to be subsequently mixed in a common fiber flow, wherein said blending device includes a fiber opening means for commonly opening said fibers from said fiber flows, and means for conveying said fiber flows to said opening means for mixing of said fiber flows to produce a desired fiber blend ratio.

7. The apparatus as set forth in claim 6 including a predetermined number of fiber storage units disposed downstream said opening means for receiving blended fibers of different blend ratios.

8. The apparatus as set forth in claim 6 including two fiber feeding and weighing means arranged in a mirror-inverted order relative to said opening means.

9. The apparatus as set forth in claim 6 including an additional fiber feeding and weighing means for said fiber flows disposed in axial alignment of said opening means at least one side of said opening means.

10. The apparatus as set forth in claim 6 characterized in that said weighing means comprises an angular channel including a generally vertical channel portion and an adjoining horizontal channel portion containing said weighing means, said weighing means including a conveyor belt, said fiber feed means for depositing fibers layerwise at the beginning of the upright channel portion.

11. The apparatus as set forth in claim 10 characterized in that said upright channel portion includes a downwardly tapered wall and includes a downwardly flared wall spaced from and opposed to said downwardly tapered wall, and said downwardly flared wall is adjustable in width.

12. The apparatus as set forth in claim 10 characterized in that said feed means includes a cell wheel having a circulating element having a plurality of cell chambers covered by a transverse screening surface.

13. The apparatus as set forth in claim 6 characterized in that between said weighing means and said opening means is disposed a conveyor roller system which includes upper and lower feed rollers which form a receptacle space tapered wedgewise towards the opening means.

14. The apparatus as set forth in claim 13 characterized in that one upper feed roller has a diameter substantially larger than that of the other feed rollers.

15. The apparatus as set forth in claim 13 including a pair of intake rollers disposed following said conveyor roller system, and separate control drives for said conveyor roller system and said intake rollers.

16. The apparatus as set forth in claim 6 including a pneumatic means for removing connected to said opening means for removing fibers.

17. The apparatus as set forth in claim 6 including a sensor for sensing humidity and for generating a signal representing said humidity, sensor and control means for controlling the intake rollers in response to said sensor signal in order to maintain the weight of the fiber material conveyed from said weighing means constant.

18. A textile fiber blending apparatus comprising in combination:

a fiber opening means for opening fibers;

a plurality of fiber flows containing fibers for delivery to said opening means, said fibers being commonly opened and mixed by said opening means;

a plurality of fiber conveyor means for conveying said fiber flows to said fiber opening means;

fiber weighing means for weighing each of said fiber flows being conveyed to said opening means;

independent fiber intake means for delivering fiber from each of said fiber conveyor means to said opening means independently; and control means for controlling the rate of operation of said intake means in response to said weighing means to provide a blend of fibers from said plurality of fiber flows having a desired blend ratio.

19. The apparatus of claim 18 including means for feeding fibers in generally vertical layers and for arranging said generally vertical layers in generally upright sections for feeding and weighing on said fiber conveyor means.

* * * * *